US009409761B2

(12) United States Patent
Lasnier et al.

(10) Patent No.: US 9,409,761 B2
(45) Date of Patent: Aug. 9, 2016

(54) REFILLABLE BOTTLE FOR DISPENSING A FLUID PRODUCT

(71) Applicants: Jacky Lasnier, Sainte Marguerite sur Duclair (FR); Thomas Roosel, Notre Dame d'Aliermont (FR)

(72) Inventors: Jacky Lasnier, Sainte Marguerite sur Duclair (FR); Thomas Roosel, Notre Dame d'Aliermont (FR)

(73) Assignee: Albea Le Treport S.A.S, Le Treport (FR)

( * ) Notice: Subject to any disclaimer, the term of this patent is extended or adjusted under 35 U.S.C. 154(b) by 0 days.

(21) Appl. No.: 14/054,056

(22) Filed: Oct. 15, 2013

(65) Prior Publication Data

US 2014/0102584 A1 Apr. 17, 2014

(30) Foreign Application Priority Data

Oct. 15, 2012 (FR) ..... 12 59828

(51) Int. Cl.

| | |
|---|---|
| ***B67D 7/02*** | (2010.01) |
| ***B05B 11/00*** | (2006.01) |
| *A45D 34/00* | (2006.01) |
| *A45D 34/02* | (2006.01) |

(52) U.S. Cl.

CPC ..... *B67D 7/0294* (2013.01); *B05B 11/0056* (2013.01); *A45D 34/00* (2013.01); *A45D 34/02* (2013.01); *A45D 2200/057* (2013.01); *B05B 11/3049* (2013.01)

(58) Field of Classification Search

CPC ..... B67D 7/74

USPC ..... 141/18, 113, 114, 115, 116, 118, 274, 141/311 R, 319, 320, 321, 325, 326, 330, 141/346, 347, 363, 364, 365, 366; 222/153.04, 402.19

See application file for complete search history.

(56) References Cited

U.S. PATENT DOCUMENTS

| | | | | |
|---|---|---|---|---|
| 545,147 | A * | 8/1895 | Benner | 141/29 |
| 2,345,854 | A * | 4/1944 | Margolies | 239/355 |

(Continued)

FOREIGN PATENT DOCUMENTS

| | | |
|---|---|---|
| AU | 571567 B2 | 4/1985 |
| FR | 2802447 A1 | 6/2001 |

(Continued)

*Primary Examiner* — Mark A Laurenzi
*Assistant Examiner* — Andrew Schmid
(74) *Attorney, Agent, or Firm* — St Onge Steward Johnston and Reens LLC

(57) ABSTRACT

A refillable bottle for dispensing a fluid product including a body in which a reservoir designed for conditioning the product is formed, the bottle including a dispensing device of the conditioned product that is mounted sealed on the body, the bottle being fitted with a reservoir filling valve arranged to enable communication of a product source with the reservoir to refill it, the valve including a communication passage between the source and the reservoir, the passage having a seating fitted with a check valve that is free to move relative to the seating between a sealed closed position and an open position of the passage, the bottle including a device for locking the check valve in the closed position, the device being arranged to be deactivated leaving the check valve in the closed position to release subsequent displacement of the check valve into the open position.

16 Claims, 6 Drawing Sheets

(56) References Cited

U.S. PATENT DOCUMENTS

| | | | | |
|---|---|---|---|---|
| 2,401,674 | A * | 6/1946 | Vizay | 141/294 |
| 2,433,989 | A * | 1/1948 | Hansen | H01M 2/362 137/261 |
| 2,714,805 | A * | 8/1955 | Zellweger | 141/330 |
| 2,906,300 | A * | 9/1959 | Becher | 141/18 |
| 3,094,250 | A * | 6/1963 | Molyneaux et al. | 222/207 |
| 3,205,919 | A * | 9/1965 | Kovacs | 141/20.5 |
| 3,246,807 | A * | 4/1966 | Micallef | 222/207 |
| 3,343,718 | A * | 9/1967 | Siegel et al. | 222/1 |
| 3,556,171 | A * | 1/1971 | Gangwisch et al. | 141/3 |
| 4,277,001 | A * | 7/1981 | Nozawa | 222/321.4 |
| 5,072,762 | A * | 12/1991 | Jimenez | 141/329 |
| 5,150,823 | A * | 9/1992 | Sugita | 222/386 |
| 5,259,423 | A * | 11/1993 | Simmel et al. | 141/1 |
| 5,431,205 | A * | 7/1995 | Gebhard | 141/351 |
| 5,524,680 | A * | 6/1996 | de Laforcade | 141/18 |
| 5,839,623 | A * | 11/1998 | Losenno et al. | 222/402.1 |
| 5,960,840 | A * | 10/1999 | Simmel et al. | 141/346 |
| 6,237,649 | B1 * | 5/2001 | Moisio et al. | 141/100 |
| 6,240,979 | B1 * | 6/2001 | Lorscheidt | 141/2 |
| 6,390,156 | B1 * | 5/2002 | Hetherington et al. | 141/351 |
| 6,418,987 | B1 * | 7/2002 | Colasacco | 141/384 |
| 6,648,180 | B2 * | 11/2003 | Moon et al. | 222/185.1 |
| 6,863,093 | B2 * | 3/2005 | Garcia et al. | 141/2 |
| 7,210,508 | B2 * | 5/2007 | Behar | A45D 34/02 141/319 |
| 7,377,296 | B2 * | 5/2008 | Gueret | 141/352 |
| 8,118,066 | B2 * | 2/2012 | Muhlhausen et al. | 141/18 |
| 8,152,025 | B2 * | 4/2012 | Foster | 222/129 |
| 8,459,312 | B2 * | 6/2013 | Manera et al. | 141/27 |
| 8,545,441 | B2 * | 10/2013 | Matusch | 604/89 |
| 8,695,896 | B2 * | 4/2014 | Tu | 239/333 |
| 2002/0056476 | A1 * | 5/2002 | Oi | F16K 35/16 137/383 |
| 2005/0016622 | A1 * | 1/2005 | Risch et al. | 141/113 |
| 2005/0284891 | A1 * | 12/2005 | Ramet et al. | 222/321.7 |
| 2007/0051410 | A1 * | 3/2007 | Mackal | F16K 15/18 137/522 |
| 2007/0119517 | A1 * | 5/2007 | Grace | 141/319 |
| 2008/0005828 | A1 * | 1/2008 | Slade | 4/231 |
| 2009/0194191 | A1 * | 8/2009 | Turgeman | A45D 34/02 141/18 |
| 2011/0024465 | A1 * | 2/2011 | Roosel et al. | 222/321.1 |
| 2011/0240677 | A1 * | 10/2011 | Dwyer | 222/256 |
| 2011/0309110 | A1 * | 12/2011 | Dumont et al. | 222/321.7 |
| 2012/0090730 | A1 * | 4/2012 | Dumont et al. | 141/2 |
| 2012/0234432 | A1 * | 9/2012 | Lamboux | 141/2 |
| 2012/0255647 | A1 * | 10/2012 | Dumont et al. | 141/311 R |
| 2012/0312842 | A1 * | 12/2012 | Dumont et al. | 222/321.9 |
| 2012/0312843 | A1 * | 12/2012 | Dumont et al. | 222/321.9 |
| 2013/0008981 | A1 * | 1/2013 | Bloc et al. | 239/480 |
| 2013/0019991 | A1 * | 1/2013 | Muller | 141/18 |
| 2014/0060695 | A1 * | 3/2014 | Dumont et al. | 141/18 |
| 2014/0069551 | A1 * | 3/2014 | Lasnier et al. | 141/18 |
| 2014/0083557 | A1 * | 3/2014 | George et al. | 141/2 |
| 2014/0102584 | A1 * | 4/2014 | Lasnier et al. | 141/18 |
| 2014/0102585 | A1 * | 4/2014 | Lasnier et al. | 141/18 |
| 2014/0137983 | A1 * | 5/2014 | Tu | 141/113 |
| 2014/0305543 | A1 * | 10/2014 | Lasnier et al. | 141/18 |

FOREIGN PATENT DOCUMENTS

| | | | | |
|---|---|---|---|---|
| WO | WO 9321103 | A1 * | 10/1993 | B67D 5/00 |
| WO | 2011026969 | A1 | 3/2011 | |

* cited by examiner

REFILLABLE BOTTLE FOR DISPENSING A FLUID PRODUCT

FIELD OF THE INVENTION

The invention relates to a refillable bottle for dispensing a fluid product, and an assembly comprising such a bottle and a product source from which said bottle will be filled.

BACKGROUND OF THE INVENTION

In particular, the refillable bottle can be used to dispense a liquid product, for example a cosmetic skincare, makeup or perfume product, or a pharmaceutical product.

The refillable bottle comprises a body inside which a product conditioning reservoir is formed, and a device for dispensing the conditioned product mounted sealed on said body. In particular, the dispensing device may include drawing off means in the form of a manually actuated pump supplied with said conditioned product, said pump being designed to dispense the product under pressure, for example in the form of an aerosol. As a variant, the dispensing device may comprise product application means, for example in the form of a ball.

In one example application, the refillable bottles according to the invention can be used for the distribution of product samples, particularly for a product volume of between 1 and 10 ml contained in the reservoir. In particular, the samples thus distributed should enable a customer to test the product, the bottles then being qualified as tester sample bottles. As a variant, the bottles may be called "handbag bottles" in that they can be used to easily transport a small volume of product, unlike larger volume bottles that are usually heavy and cumbersome because they are more luxurious.

In these applications, for example for logistic reasons, or because it is more practical or for environmental recycling purposes, it may be desirable to be able to refill the reservoir with product from a source of said product. Indeed, it is not very practical for a user to have to use a small funnel to refill the reservoir and it is not very ecological to discard an empty bottle to replace it with a new bottle acting as a refill.

Refillable bottles are already available for sale, in which the body is fitted with a reservoir filling valve that is arranged to enable communication between a product source and said reservoir so that said reservoir can be refilled. In particular, the valve includes a communication passage between the source and the reservoir, said passage having a seating fitted with a check valve that is free to move relative to said seating between a sealed closed position and a position in which said passage is open.

In prior art, filling is done by using a source bottle comprising a distribution pump, the check valve being moved by the jet of said pump. In particular, the check valve is elastically held in the closed position and the sealed bearing contact of the jet on the check valve reversibly opens said check valve and actuates the pump to inject the source product into the reservoir through the valve.

However, this embodiment introduces sealing problems when filling, particularly because it is difficult to position the jet correctly with a sealed bearing contact on the check valve by applying sufficient force to open the check valve and actuate the pump at the same time, especially because the pump has to be actuated several times to inject a sufficient volume of product.

SUMMARY OF THE INVENTION

The invention is intended to improve prior art particularly by disclosing a refillable bottle that has a filling valve that, when actuated, creates a reliable seal during filling, with a particularly easy and intuitive manipulation.

To achieve this, according to a first aspect, of the invention discloses a refillable bottle for dispensing a fluid product comprising a body in which a reservoir designed for conditioning said product is formed, said bottle comprising a dispensing device of said conditioned product that is mounted sealed on said body, said bottle being fitted with a reservoir filling valve arranged to enable communication of a product source with said reservoir to refill it, said valve comprising a communication passage between said source and said reservoir, said passage having a seating fitted with a check valve free to move relative to said seating between a sealed closed position and an open position of said passage, said bottle comprising a device for locking the check valve in the closed position, said device being arranged to be deactivated by leaving said check valve in the closed position in order to release subsequent displacement of said check valve into the open position.

According to a second aspect, the invention discloses an assembly comprising such a refillable bottle and a product source designed to fill said refillable bottle, said source comprising a product reservoir fitted with a socket designed to enable the sealed connection of the filling valve on the source reservoir by putting the passage in communication with said reservoir.

BRIEF DESCRIPTION OF THE DRAWINGS

Other objects and advantages of the invention will appear in the following description, made with reference to the appended figures, in which.

DETAILED DESCRIPTION OF THE INVENTION

Figure 1:
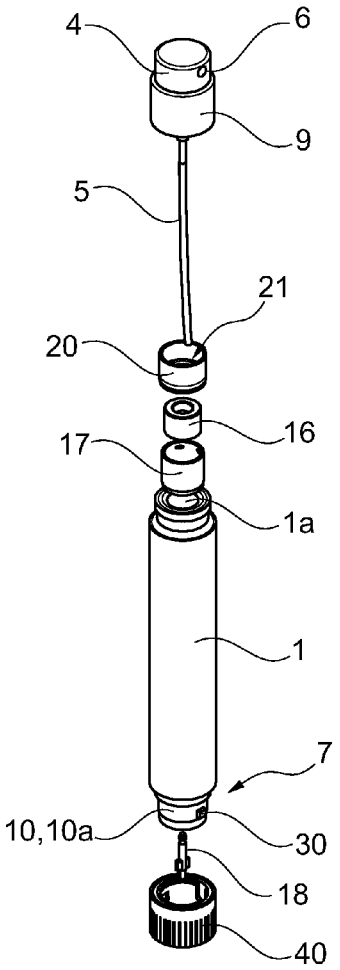
FIG. 1 shows an exploded perspective view of a refillable bottle according to one embodiment of the invention.
Figure 2:
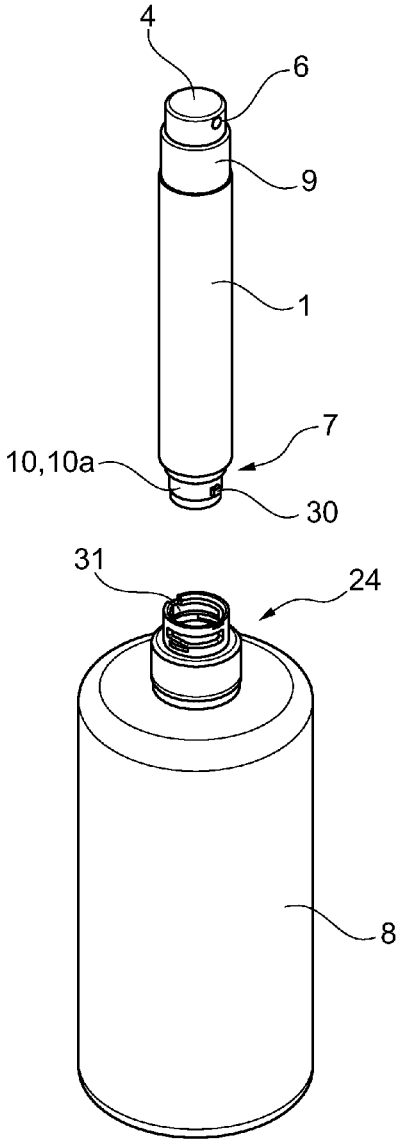
FIG. 2 shows a perspective view of the assembly formed by a refillable bottle and a source bottle, each being assembled and ready to be connected.
Figure 3A:
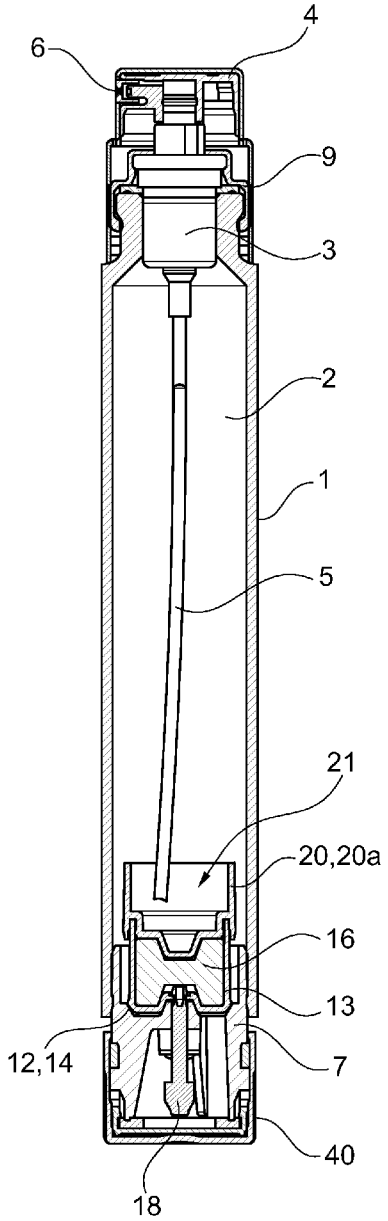
FIGS. 3*a*-3*b* show the bottle in FIG. 1 respectively in a longitudinal section (FIG. 3*a*) and in a partial view showing the bottom of the bottle in FIG. 3*a* (FIG. 3*b*)
Figure 3B:
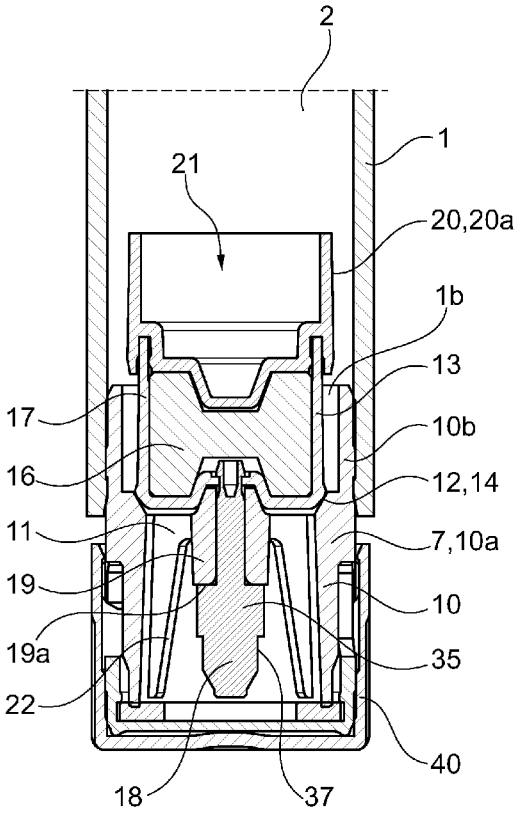
Figure 4A:
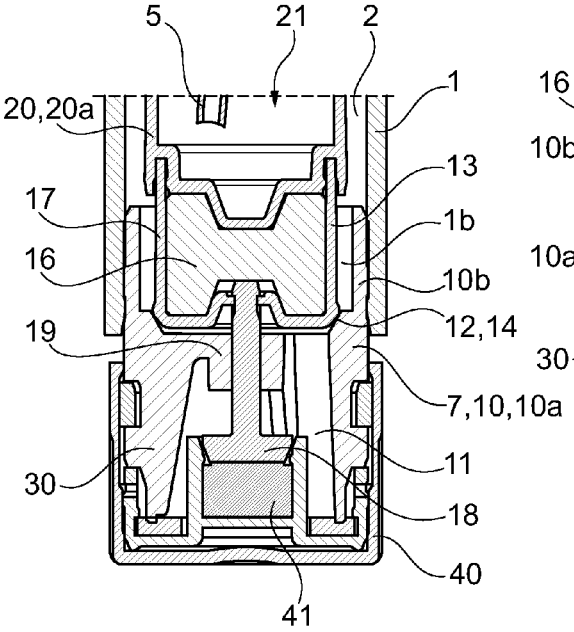
FIGS. 4*a*-4*b* show the bottom of a dispensing bottle according to another embodiment of the invention, respectively with the cap installed on the valve in the locked state of the check valve (FIG. 4*a*) and with the cap removed (FIG. 4*b*) to deactivate locking, respectively.
Figure 4B:
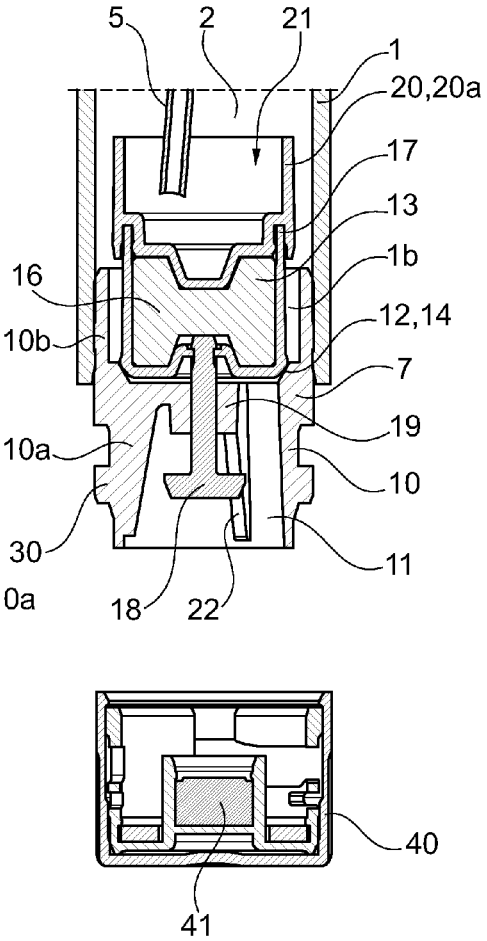
Figure 9A:
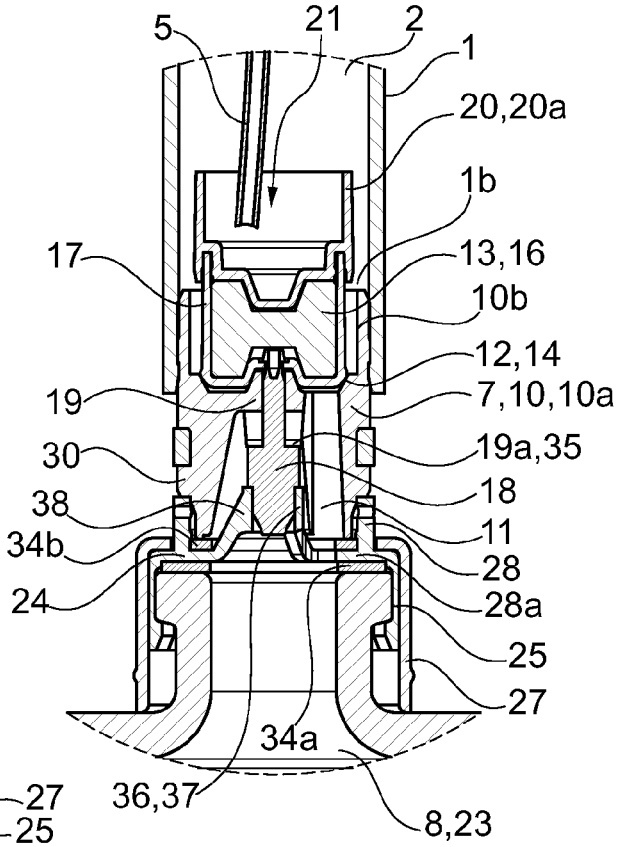
FIGS. 9*a*-9*b* are partial and longitudinal sectional views of the connection of the refillable bottle on the source bottle, respectively in the upright closed and sealed position (FIG. 9*a*) and in the upside-down position in which the passage is open ready for refilling (FIG. 9*b*).

In the description, positioning terms in space are referenced relative to the upright position of the refillable bottle as shown in particular in FIGS. 3, 4 and 9*a*.

The following description given with reference to the figures discloses a refillable bottle designed to contain a fluid product for distribution. In specific examples, the product may be liquid, particularly a cosmetic skincare, makeup or perfume product, or a pharmaceutical product.

The refillable bottle comprises a body 1 in which a product conditioning reservoir 2 is formed. According to one particular application, the capacity of the reservoir 2 may be between 1 and 10 ml for the distribution of product samples.

In the embodiments shown, the body 1 is rigid, and in particular is sufficiently stiff so that the volume of the reservoir 2 remains substantially constant, even if the internal pressure varies. The body 1 may be made from a single-piece and may for example be made by injection blow moulding or extrusion blow moulding, or in several injected parts subsequently assembled for example by ultrasound welding, or by laser, or by rotary friction, made of a rigid plastic material or metallic, for example aluminium, or glass.

The bottle comprises a conditioned product dispensing device mounted sealed in the body 1. In the embodiment shown, the dispensing device comprises a pump 3 actuated manually by means of a push button 4, said pump being supplied with product through a dip tube 5 located in the reservoir 2.

However, the invention is not limited to one particular method of dispensing the product. In particular, other means for drawing off the product from the reservoir 2 may be envisaged. The dispensing device may also comprise product application means, for example in the form of a ball.

The push button 4 comprises a dispensing orifice 6 and an upper zone on which the user can press his (her) finger so as to move the jet of the pump 3 along its path to supply said orifice with product under pressure. In the embodiment shown, the push button 4 is fitted with a spray nozzle that is arranged to radially dispense an aerosol of the product through the dispensing orifice 6. However, particularly for a nasal spray end piece, the push button 4 can enable axial dispensing of the product. As a variant, the product may be delivered in the form of a dab or a ribbon.

The bottle is fitted with a filling valve 7 of the reservoir 2 that is arranged to enable communication between a product source 8 and said reservoir so that said reservoir can be refilled. In relation with the figures, the body 1 has an upper opening 1*a* in which the pump 3 is installed through a collar ring nut assembly 9, and a lower opening 1*b* fitted with the filling valve 7.

The lower opening 1*b* is formed in the bottom of the body 1 and the filling valve 7 comprises a skirt 10 that extends in the axial direction peripherally under said opening. Thus, a communication passage 11 is formed between the product source 8 and the reservoir 2, said passage extending in the skirt 10.

In the figures, the skirt 10 is shown as fitted under the body 1, but it could also be formed in a single piece with said body. More precisely, the filling valve 7 comprises a hollow housing 10*a* of which the upper wall 10*b* is force fitted in the lower opening 1*b*, the skirt 10 being formed under said upper wall to extend outside the body 1.

The communication passage 11 has a seating 12 fitted with a check valve 13 free to move relative to said seating between a sealed closed position and a position in which said passage is open. In particular, the seating 12 may be formed on the inner periphery of the skirt 10.

The bottle comprises a device to lock the check valve 13 in the closed position, so that said check valve can be prevented from moving into the open position, particularly between two fillings, to prevent the product from leaking through the valve 7. Furthermore, the locking device is arranged so that it is deactivated by leaving the check valve 13 is left in the closed position to release subsequent displacement of said check valve into the open position.

Thus, the manipulation to unlock the check valve 13 is dissociated from the manipulation to open it for filling, particularly to eliminate unlocking constraints to improve the seal during filling. In particular, in the unlocked state, the displacement of the check valve 13 between its closed and open positions is unhindered, in other words in particular it is not hindered by an add-on means so as to limit the force necessary to open the check valve 13.

In the embodiments shown, the check valve 13 is arranged so that it is free to move between its closed and open positions under the effect of gravity induced by positioning the refillable bottle in an upright position (FIG. 9*a*) and an upside-down position (FIG. 9*b*) respectively. Thus, after unlocking check valve 13, filling is done simply by the product flowing under gravity and an air transfer in the opposite direction through the passage 11 between the product source 8 and the reservoir 2 to be filled, filling being possible simply by fitting the refillable bottle in the upright position on the product source 8 and then turning the refillable bottle-product source 8 assembly into the upside-down position.

In particular, the upright position corresponds to the normal usage position of the refillable bottle in which the push button 4 is at the top. As a variant, the refillable bottle in the upright position may be oriented differently, provided that the check valve 13 is in the closed position under the effect of gravity.

The refillable bottle in the upright position may be mounted and connected on the product source 8 without inducing any product transfer, particularly because said product is not pressurised. The upside-down position is then reached by rotating the refillable bottle-product source 8 assembly so that said source is above the reservoir 2 so as to induce filling by flow. In FIG. 9, the rotation is 180° but the angle could be different, provided that it is large enough to open the check valve 13 under the effect of gravity.

After refilling, the refillable bottle-product source 8 assembly is put back into the initial position before said bottle is disconnected so that it can be used later. In particular, turning over causes closing of the check valve 13 under the effect of gravity.

According to another embodiment, after the check valve 13 is unlocked, the bottle may be filled by suction, for example by planning that the reservoir 2 has a sufficient negative air pressure to actuate opening of the check valve 13 and the product transfer from the product source 8.

According to another embodiment, when the check valve 13 has been unlocked, the bottle may be filled by injection, for example by opening the check valve 13 by a source bottle jet pressing on it, the force necessary for said press being low because the unlocked check valve 13 is free to move between its open and closed positions.

Figure 9B:
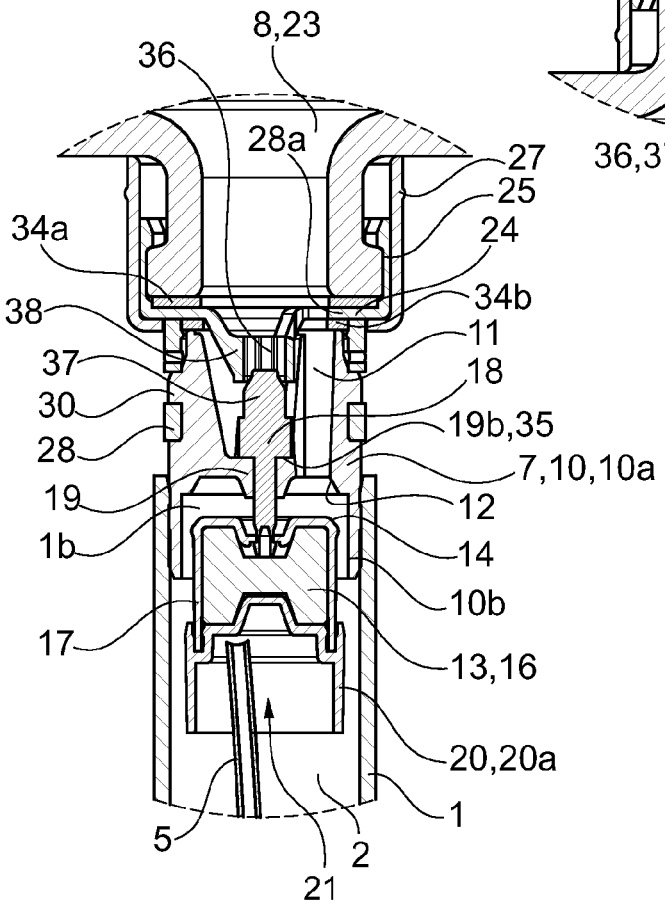

With reference to the figures, the check valve 13 comprises an annular contact surface 14 that, when in the closed position, is in sealed contact with the seating 12 that has a complementary contact surface (FIG. 9*a*), said contact surface in the open position being arranged at a distance from said complementary contact surface (FIG. 9*b*). To improve the seal in the closed position, the contact surface 14 and the complementary contact surface of the seating 12 may be tapered.

Moreover, the check valve 13 is provided with a ballast 16 heavy enough to move said check valve between its open and closed positions. In particular, the ballast 16 induces a sealing contact force between the annular contact surface 14 and the seating 12 and assures that said contact surface separates when turned upside-down.

In the embodiment shown, the check valve 13 is free to move in axial translation between its closed and open positions. As a possibly complementary variant, the check valve 13 may be free to move between its closed and open positions by deformation induced by gravity, and particularly by deformation of the annular contact surface 14 on the seating 12.

In the figures, the check valve 13 comprises an upper cage 17 with a lower rim on which the annular contact surface 14 is formed, an add-on ballast 16, for example made of metal, being fixed in said cage. As a variant, the ballast 16 may form part of the check valve 13, particularly by making said check valve made from a high density material, for example a polymer filled with metallic particles or directly from a metallic material.

The check valve 13 comprises a lower stem 18 that extends under the cage 17, said stem being fitted free to slide in a tube 19 fixed to the skirt 10, said stem and said tube being arranged to define the limit of movement of the check valve 13 in the open position. In the embodiment shown, the upper end of the stem 18 is click fitted into a lower orifice of the cage 17, but said stem can be formed in a single piece with said cage.

Moreover, the cage 17 has a cover 20 that isolates the ballast 16 from contact with the conditioned product in the reservoir 2. The cover 20 also forms a bell 21 fixed to the check valve 13 while being located in the reservoir 2, said bell being arranged such that it will be in communication with said reservoir when in the upright position (FIG. 9*a*), and it will be isolated from said reservoir when in the upside-down position (FIG. 9*b*) so that it will not be filled by the product from the source 8.

To achieve this, the cover 20 has an axial peripheral wall 20*a* that extends on a radial lower wall, the bell 21 being formed inside said walls to form a retention volume open in the upper part. In particular, the walls 20*a* are laid out such that the retention volume when in the upside-down position is not in flow communication with the passage 11.

Thus, when the reservoir 2 is emptied, an air volume is formed that is retained in the bell 21 when turned upside-down and is then released in said reservoir when returning to the upright position, guaranteeing that there is an air blanket in said reservoir after refilling. In particular, the air blanket allows the product to expand when the temperature rises without exceeding the allowable pressure in the reservoir 2, for example of the order of 5 bars. This embodiment is particularly advantageous when the product contains alcohol, for example by allowing a retention volume in the bell 21 of the order of 5 to 7% of the conditioning volume of the reservoir 2.

Figure 5A:
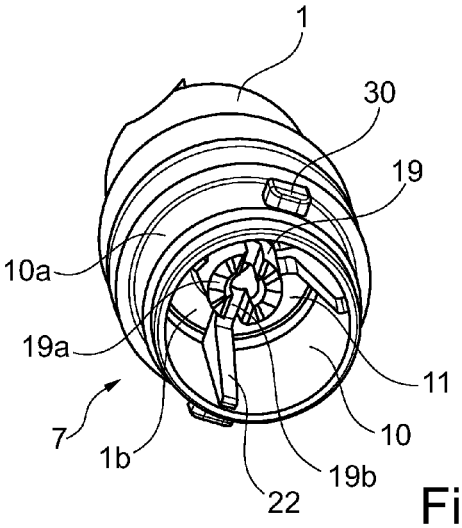
FIGS. 5*a*-5*b* are partial views showing the communication passage in the filling valve of the refillable bottle according to FIG. 1, respectively in perspective views with the stem removed (FIG. 5*a*) and with the stem in position in the locked state (FIG. 5*b*) respectively.
Figure 5A:
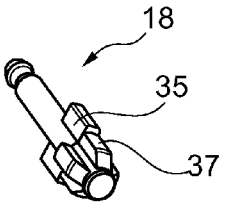
Figure 5B:
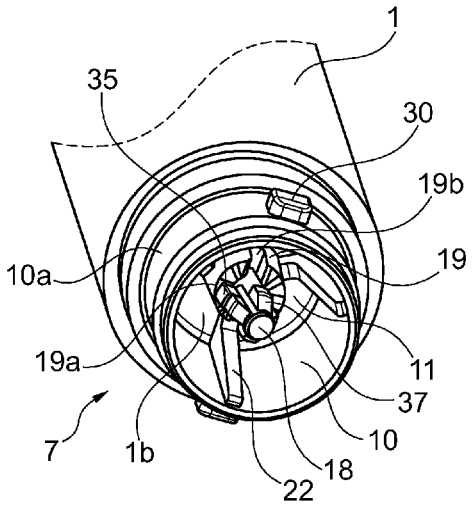

The tube 19 is installed in the skirt 10 through at least one rib 22. With reference to FIG. 5, three ribs 22 are provided to form three openings in the communication passage 11. The ribs 22 are arranged to facilitate parietal flow of the product in the communication passage 11, particularly by being connected to the inside of the skirt 10 over substantially its entire dimension in the axial direction, and by presenting each a free edge converging towards a radial base connected to the periphery of the tube 19.

Thus, flow of the product contained in the communication passage 11 into the source 8 is facilitated when the refillable bottle is put back into its upright position at the end of the refill operation so that the product does not leak under the refillable bottle when it is disconnected.

Similarly, the filling valve 7 may have hydrophobic surfaces which is arranged to facilitate product flow in the communication passage 11. In particular, the inside of the housing 10*a* may be made hydrophobic, for example by fluorinated plasma treatment, by dipping in a silicone bath or by making said housing from a hydrophobic material such as PTFE.

The product source 8 comprises a product reservoir 23, particularly formed inside a bottle with a higher capacity than the refillable bottle. In another embodiment, the source reservoir 23 is formed inside a flexible pouch that can be filled with product without air or gas to assure good conservation of said product.

The source reservoir 23 is fitted with a socket 24 designed to enable a sealed connection of the filling valve 7 on said source reservoir by connecting it to the communication passage 11. Furthermore, the filling valve 7 is fitted with a device for making a sealed connection of the bottle onto the product source 8, the socket 24 being fitted with a connection device complementary to the connection device of the filling valve 7.

With reference to FIGS. 1 to 3 and 5 to 9, the locking device of the check valve 13 is designed to be deactivated when sealed connection between the bottle and the product source 8 is made. In particular, the socket 24 comprises means of deactivating the locking device of the check valve 13 by the sealed connection of the bottle onto the product source 8. The locking device is also designed so that it is reactivated when the refillable bottle is disconnected.

Figure 6A:
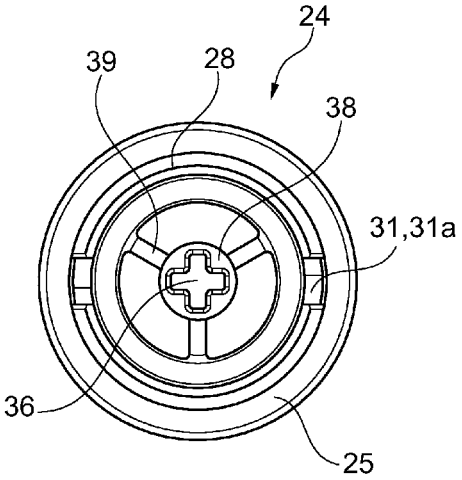
FIGS. 6*a*-6*c* are partial views showing the connection socket of the source bottle according to FIG. 2, respectively in a top view (FIG. 6*a*), side view (FIG. 6*b*) and perspective view (FIG. 6*c*)
Figure 6B:
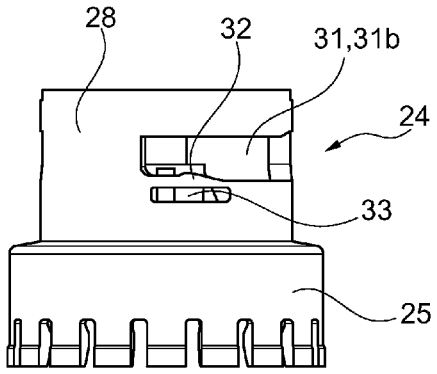
Figure 6C:
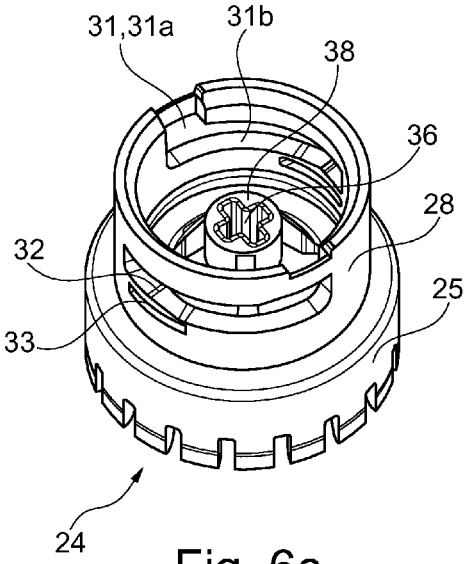
Figure 7A:
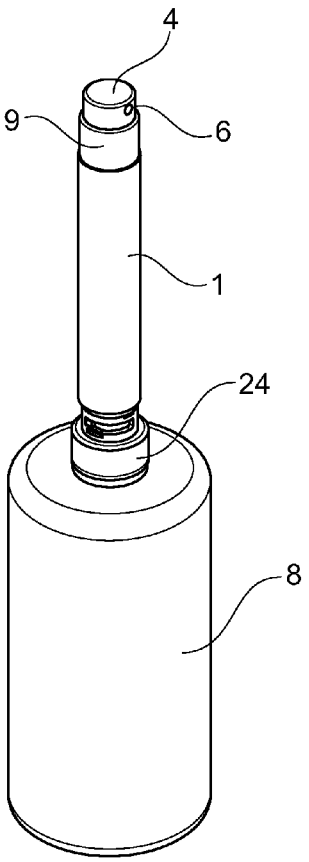
FIGS. 7*a*-7*b* and 8*a*-8*b* show the filling bottle mounted on the source bottle (FIG. 7*a*) and the connection between them made by unlocking the check valve in the closed position (FIG. 8*a*), FIGS. 7*b* and 8*b* being cross sections of FIGS. 7*a* and 8*a* respectively showing the layout of the stem in the socket.

With reference to FIG. 6, the socket 24 comprises a collar 25 for assembly onto the neck of the source bottle 8, said collar being fixed to said neck by means of a ring nut 27. The collar 25 has an upper opening above which there is a sleeve 28 extending in the axial direction around the periphery. Advantageously, the socket 24 has no means of pressuring the filling product. Thus, the bottle 8 cannot be used for any purpose other than as the source because it has no propulsion gas and no internal pressure.

The skirt 10 of the filling valve 7 is designed to slide in the axial direction relative to the sleeve 28 of the socket 24. In particular, the skirt 10 and the sleeve 28 are annular, the outside diameter of the skirt 10 being slightly less than the inside diameter of the sleeve 28 to allow clearance-free axial assembly of the refillable bottle onto the product source 8. The skirt 10 may also be slightly tapered and have a lower chamfer to enable radial gripping when said skirt slides in the axial direction in the sleeve 28.

In the embodiment shown, the connection devices comprise studs 30 fixed to the skirt 10 or to the sleeve 28, designed to cooperate with grooves 31 fixed to the sleeve 28 or to the skirt 10 so that the refillable bottle can be fixed and immobilised in the connected position onto the source reservoir 23. In the figures, a set of two diametrically opposite studs 30 is formed around the skirt 10 to cooperate with a set of two grooves 31 formed in the sleeve 28, said studs having a lower chamfer to facilitate their entry into the grooves 31.

The grooves 31 comprise an axial portion 31*a* in which the studs 30 slide and a peripheral portion 31*b* in which said studs rotate. Thus, a bayonet type manipulation is required to make a sealed connection of the refillable bottle onto the product source 8, specifically an axial assembly of the filling valve 7 into the socket 24 followed by a relative rotation to fix the refillable bottle in the connected position on the product source 8, the check valve 13 thus being released by relative rotation between said bottle and the product source 8.

In the figures, the peripheral portions 31*b* comprise a projection 32 for locking the studs 30 in the connected position. The sleeve 28 also comprises slots 33 located under the projections 32 to facilitate their deformation during locking.

An annular seal 34*a* is inserted between a radial contact surface 28*a* of the sleeve 28 and the neck of the product source 8 and, when the refillable bottle is mounted on the product source 8, the lower end of the skirt 10 bears axially on another annular seal 34*b* located on said radial contact surface. Thus, the connection of the passage 11 through which the product flows during filling is made leaktight by compression of the seals 34*a*, 34*b*.

To make a locking device that is deactivated when the refillable bottle is connected onto the product source 8, the stem 18 comprises a profile in relief and the tube 19 comprises a bottom contact surface 19*a* and *a* top contact surface 19*b*. In the figures, the profile is formed by two pins 35 on each side of the stem 18, the lower surface of the tube 19 comprising two diametrical notches angularly offset by 90° to form respectively the bottom and top contact surfaces 19*a* and 19*b*.

Figure 8A:
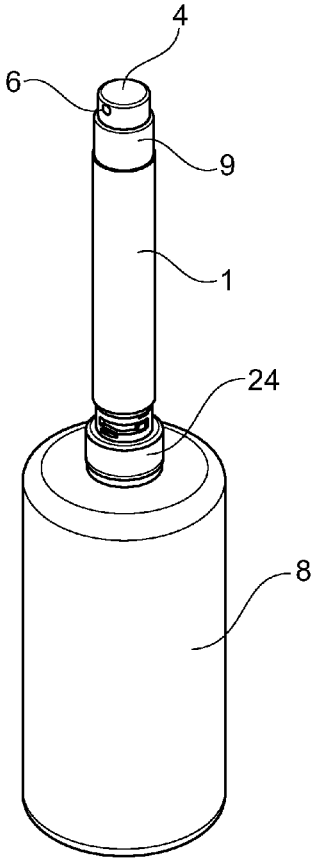
Figure 7B:
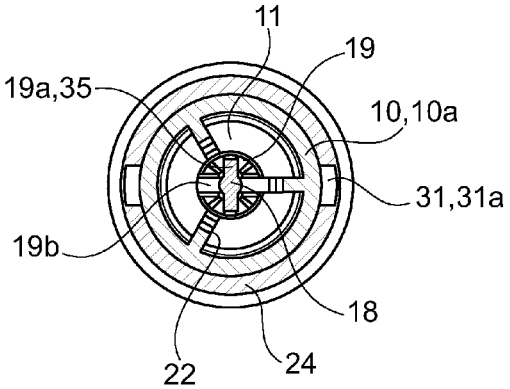
Figure 8B:
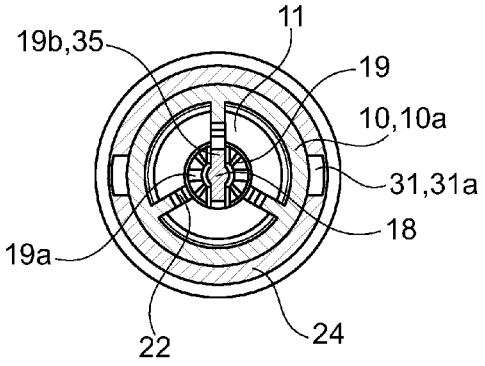

The stem 18 and the tube 19 can be displaced relative to each other between a locked position in which the profile 35 is located on the bottom contact surface 19*a* to hold the check valve 13 in the closed position (FIG. 7) and a released position in which the profile 35 can slide towards the top contact surface 19*b* to enable displacement of the check valve 13 into the open position (FIG. 8). Furthermore, this embodiment defines the displacement limit stop of the check valve 13 in the open position by axial bearing of the pins 35 on the top contact surface 19*b*.

To make the unlocking displacement during the connection, the socket 24 comprises a cavity 36 inside which a rib 37 of the stem 18 is located in the assembly position of the valve 7 in the socket 24 (FIG. 7), said rib and said cavity being arranged so that the stem 18 is fixed to the socket 24 in rotation so that the connection rotation displaces the tube 19 relative to the stem 18 between their locked and released positions.

Similarly, after refilling, returning the refillable bottle product source 8 assembly into the upright position brings the pins 35 below the top contact surface 19*b*, in other words to the closed released position of the check valve 13, such that the disconnection rotation of the bottle induces displacement of the tube 19 relative to the stem 18 into their locked position.

In particular, the connection rotation angle is equal to the release rotation angle corresponding to the angular offset between the bottom and top contact surfaces 19*a* and 19*b*. Consequently, in function of the required manipulation for the connection the angular offset of the bottom and top contact surfaces 19*a* and 19*b* must be adapted, for example more or less a quarter turn.

In the figures, the socket 24 comprises a central pad 38 located in the sleeve 28 through arms 39, the cavity 36 being formed in said pad, for example in the form of a cross-shaped orifice in which there are four ribs 37 formed under the pins 35. As a variant, the cavity 36 may be arranged to enable engagement of the pins 35 so to fix in rotation the stem 18 with the socket 24 during the connection.

Advantageously, the filling valve 7 and/or the socket 24 are fitted with a cap 40 arranged to maintain the seal of the reservoirs 2, 23 between two fillings. Each cap 40 comprises a connection device that is complementary to the connection device of the filling valve 7 or of the socket 24. Thus, the caps 40 may be removed before filling and put back into place after filling by means of a manipulation similar to the manipulation respectively for the disconnection and connection of the refillable bottle on the product source 8.

As can be seen in FIG. 4, the bottle cap comprises means of locking the check valve 13 in the closed position in order to deactivate said locking by removing said cap before filling.

In particular, the locking means may comprise a magnet 41 fixed to the cap 40, the stem 18 having magnetic properties such that it can be fixed magnetically when said cap is installed. Thus, once the cap 40 has been removed, if there is no magnetic force, the check valve 13 is free to move between its closed and open positions to enable filling, particular by turning upside-down.

What is claimed is:

1. A refillable bottle for dispensing a fluid product comprising a body wherein a reservoir designed for conditioning said product is formed, said bottle comprising a dispensing device of said conditioned product that is mounted sealed on said body, said bottle being fitted with a reservoir filling valve arranged to enable communication of a product source with said reservoir to refill said reservoir, said valve comprising a communication passage between said product source and said reservoir, said passage having a seating fitted with a check valve that is free to move relative to said seating between a sealed closed position and an open position of said passage, wherein said bottle comprises a locking device for locking the check valve in the closed position, said locking device being arranged to be deactivated by leaving said check valve in a closed position to release subsequent displacement of said check valve into the open position, characterised in that, in an unlocked state, the check valve is free to move between the closed and open positions under the effect of gravity induced by positioning said bottle in an upright position and an upside-down position, respectively.

2. The refillable bottle according to claim 1, characterised in that the check valve is provided with a ballast heavy enough to move said check valve between the open and closed positions.

3. The refillable bottle according to claim 1, characterised in that the filling valve is fitted with a device for making a sealed connection of said bottle to the product source.

4. The refillable bottle according to claim 3, characterised in that the check valve locking device is arranged to be deactivated by the sealed connection of said bottle to the product source.

5. The refillable bottle according to claim 1, characterised in that the filling valve is fitted with a cap that includes the locking device for locking the check valve in the closed position, said locking device deactivated by removing said cap before filling.

6. The refillable bottle according to claim 1, characterised in that the filling valve comprises a skirt wherein the communication passage extends, the check valve comprising a lower stem that is mounted free to slide in a tube fixed to said skirt.

7. The refillable bottle according to claim 6, characterised in that the stem comprises a profile in relief, the tube comprising a bottom contact surface and a top contact surface, said stem and said tube being able to displace relative to each other between a locked position wherein the profile is located on the bottom contact surface to hold the check valve in the closed position and a released position wherein the profile can slide towards the top contact surface to enable displacement of the check valve into the open position.

8. The refillable bottle according to claim 7, further comprising a bell located in the reservoir, said bell being arranged to be in communication with said reservoir when in the upright position, and to be isolated from said reservoir when in the upside-down position so that said bell will not be filled by the product from the product source.

9. An assembly, comprising:

a refillable bottle comprising a body wherein a reservoir designed for conditioning said product is formed, said bottle comprising a dispensing device of said conditioned product that is mounted sealed on said body, said bottle being fitted with a reservoir filling valve arranged to enable communication of a product source with said reservoir to refill said reservoir, said valve comprising a communication passage between said product source and said reservoir, said passage having a seating fitted with a check valve that is free to move relative to said seating between a sealed closed position and an open position of said passage, wherein said bottle comprises a locking device for locking the check valve in the closed position, said locking device being arranged to be deactivated by leaving said check valve in a closed position to release subsequent displacement of said check valve into the open position; and said product source comprising a source reservoir fitted with a socket designed to enable the sealed connection of the filling valve on the source reservoir by putting the passage in communication with said reservoir characterised in that, in an unlocked state, the check valve is free to move between the closed and open positions under the effect of gravity induced by positioning said bottle in an upright position and an upside-down position, respectively.

10. The assembly according to claim 9, characterised in that the filling valve of said bottle is fitted with a device for making a sealed connection of said bottle to the product source, and the check valve locking device is arranged to be deactivated by the sealed connection of said bottle to the product source, and characterised in that the socket of said product source is fitted with a connection device complementary to the connection device of the filling valve, said socket comprising means of deactivating the check valve locking device by sealed connection of said bottle on the product source.

11. The assembly according to claim 10, characterised in that the connection devices allow axial assembly of the check valve in the socket followed by a relative rotation to fix the refillable bottle in the position connected to the product source.

12. The assembly according to claim 11, characterised in that the filling valve comprises a skirt wherein the communication passage extends, the check valve comprising a lower stem that is mounted free to slide in a tube fixed to said skirt, characterised in that the stem comprises a profile in relief, the tube comprising a bottom contact surface and a top contact surface, said stem and said tube being able to displace relative to each other between a locked position wherein the profile is located on the bottom contact surface to hold the check valve in the closed position and a released position wherein the profile can slide towards the top contact surface to enable displacement of the check valve into the open position, and characterised in that the socket of said product source comprises a cavity wherein a rib of the stem is arranged in the assembly position of the valve in the socket, said rib and said cavity being arranged so that the stem is fixed to the socket in rotation so that the connection rotation displaces the tube relative to the stem between their locked and released positions.

13. The refillable bottle according to claim 1, further a bell located in the reservoir, said bell being arranged to be in communication with said reservoir when in the upright position, and to be isolated from said reservoir when in the upside-down position so that said bell will not be filled by the product from the source.

14. The refillable bottle according to claim 5, wherein the check valve includes a stem with magnetic properties, and wherein the locking device includes a magnet in the cap.

15. A refillable bottle for dispensing a fluid product, comprising:

a body including a reservoir for containing the fluid product;

a dispensing device for dispensing the fluid product that is mounted sealed on said body;

a reservoir filling valve fitted on said bottle and arranged to enable communication of a product source with the reservoir to refill the reservoir, said reservoir filling valve including a housing with a check valve contained in the housing and a communication passage between the product source and the reservoir, the communication passage having a seat, the check valve being free to move in the housing relative to the seat between a sealed closed position, in which the check valve is against the seat, and an open position of the communication passage, in which the check valve is separated from the seat; and a locking device for locking the check valve in the closed position within the housing of said reservoir filling valve, said locking device being arranged to be deactivated to unlock the check valve, wherein manipulation to unlock the check valve is dissociated from manipulation to open the check valve such that upon deactivation of said locking device the check valve is left in the closed position but released for subsequent displacement of said check valve into the open position, characterised in that, in the unlocked state, the check valve is free to move between the closed and open positions under the effect of gravity induced by positioning said bottle in an upright position and an upside-down position respectively.

16. The refillable bottle according to claim 15, characterised in that the filling valve is fitted with a device for making a sealed connection of said bottle to the product source and the check valve locking device is arranged to be deactivated by the sealed connection of said bottle to the product source.

* * * * *